United States Patent [19]

Chibana

[11] 4,200,021

[45] Apr. 29, 1980

[54] ELECTRONIC MUSICAL INSTRUMENTS WHICH FORM MUSICAL TONES BY REPEATEDLY GENERATING MUSICAL TONE WAVEFORM ELEMENTS

[75] Inventor: Masanobu Chibana, Hamamatsu, Japan

[73] Assignee: Nippon Gakki Seizo Kabushiki Kaisha, Hamamatsu, Japan

[21] Appl. No.: 967,398

[22] Filed: Dec. 7, 1978

[30] Foreign Application Priority Data

Dec. 9, 1977 [JP] Japan ..... 52-147184

[51] Int. Cl.[2] ..... G10H 1/02; G10H 5/02

[52] U.S. Cl. ..... 84/1.22; 84/1.24; 84/1.26

[58] Field of Search ..... 84/1.01, 1.03, 1.11–1.13, 84/1.19, 1.21, 1.22, 1.24, 1.26

[56] References Cited

U.S. PATENT DOCUMENTS

| | | | |
|---|---|---|---|
| 3,809,786 | 5/1974 | Deutsch | 84/1.01 |
| 3,878,749 | 4/1975 | Woron | 84/1.01 |
| 4,018,121 | 4/1977 | Chowning | 84/1.01 |
| 4,026,179 | 5/1977 | Futamase | 84/1.24 |
| 4,114,497 | 9/1978 | Hiyoshi et al. | 84/1.01 X |
| 4,131,049 | 12/1978 | Okumura et al. | 84/1.01 |
| 4,133,242 | 1/1979 | Nagai et al. | 84/1.13 |
| 4,138,915 | 2/1979 | Nagai et al. | 84/1.22 |

*Primary Examiner*—S. J. Witkowski

*Attorney, Agent, or Firm*—Charles E. Pfund

[57] ABSTRACT

There is provided a first waveform generator which repeatedly generates a first waveform having a relatively short period in response to a first constant parameter, a second waveform generator responsive to a second constant parameter for generating a second waveform having a longer period than the repeatedly generated waveform and gradually approaches to zero in the later half of its period, a multiplier for multiplying the first waveform and the second waveform to form a musical tone waveform element, and means for resetting the waveform generating operations of the first and second waveform generator at a period corresponding to the tone pitch of a depressed key. Sequential alignment of the musical tone waveform elements constitutes a musical tone waveform having a tone frequency determined by the resetting period. The changes in the parameters cause changes in the tone color.

8 Claims, 15 Drawing Figures

ELECTRONIC MUSICAL INSTRUMENTS WHICH FORM MUSICAL TONES BY REPEATEDLY GENERATING MUSICAL TONE WAVEFORM ELEMENTS

BACKGROUND OF THE INVENTION

This invention relates to an electronic musical instrument utilizing digital technique and more particularly an electronic musical instrument wherein musical tones are formed by repeatedly producing musical tone waveform elements.

In an electronic musical instrument, the tone pitch control of the generated musical tone and the tone generation control are performed by key informations which are generated in accordance with the key depressing operations of a keyboard unit; and waveform memory read out systems, harmonic wave synthesizing systems, etc., have been developed as the electronic musical instrument of the digital type.

In the electronic musical instrument of the waveform memory read out type, the musical tone waveform stored in the waveform memory device is repeatedly read out with a signal having a frequency corresponding to the tone pitch of a depressed key between an instant of generating a musical tone and the termination thereof, so that once the musical tone waveform to be stored in the waveform memory device is set, the tone color of the generated musical tone would be fixed with the result that it becomes impossible to vary at will the tone color. Thus, it is impossible to obtain a tone generation performance in which the tone color of the generated tone is varied delicately with time as in natural musical instruments.

Also in the conventional electronic musical instrument of the harmonic synthesizing type, a musical tone waveform which is set by a harmonic amplitude coefficient stored in a harmonic coefficient memory device is repeatedly generated by a signal having a frequency corresponding to the tone pitch of a depressed key between an instant of generating the musical tone and the termination thereof, so that, in the same manner as in the waveform memory read out system described above, once the harmonic amplitude coefficient to be stored in the harmonic coefficient memory device is set, it becomes impossible not only to vary the color of the generated tone but also to vary with time the color of the generated tone.

In the electronic musical instrument of the waveform memory read out system of the harmonic synthesizing system described above, for the purpose of varying the color of the generated musical tone or to vary with time the tone color, it has been proposed to provide a plurality of waveform memory devices for storing different musical tone waveforms or to provide a plurality of harmonic coefficient memory devices for storing a set of harmonic amplitude coefficients having different values and to select these waveform memory device groups or the harmonic coefficient memory device groups or to sequentially select them with time. However, these expedients require a plurality of memory devices (waveform memory devices or harmonic coefficient memory devices) and their transfer control devices thus complicating the construction and increasing the cost of the electronic musical instrument.

SUMMARY OF THE INVENTION

Accordingly, it is the principal object of this invention to provide an improved electronic musical instrument wherein musical tones are formed by repeatedly generating musical tone waveform elements by a multiplication product of two different waveforms whose periods are respectively variable so that the color of the generated musical tone can readily by varied with a relativey simple construction.

Another object of this invention is to provide an electronic musical instrument capable of varying with time the tone color of the generated musical tone in addition to the performance described above.

According to this invention, there is provided an electronic musical instrument comprising a plurality of key switches which determine tone pitches of musical tones generated by the musical instrument; a periodic trigger pulse generating circuit which generates a trigger pulse having a period corresponding to a designated one of the key switches; a constant parameter generator which generates a predetermined constant parameter; first and second waveform generators responsive to the periodic trigger pulse and to the output of the constant parameter generator for producing outputs having different waveforms; a multiplying circuit to multiply with each other the outputs of the first and second waveform generators for producing a musical tone waveform element; the first waveform generator generating an oscillatory waveform; the second waveform generator generating another waveform which builds up from a predetermined reference level to a higher level and then decreases toward the reference level; the musical tone waveform element having an envelope which increases from zero to a predetermined value and then decreases to zero; and means for repeatedly generating the musical tone waveform element at a period corresponding to the period of the trigger pulse so as to form a musical tone wave thereby repeatedly generating the musical tone waveform element to form the musical tone.

DESCRIPTION OF THE PREFERRED EMBODIMENTS

Figure 1:
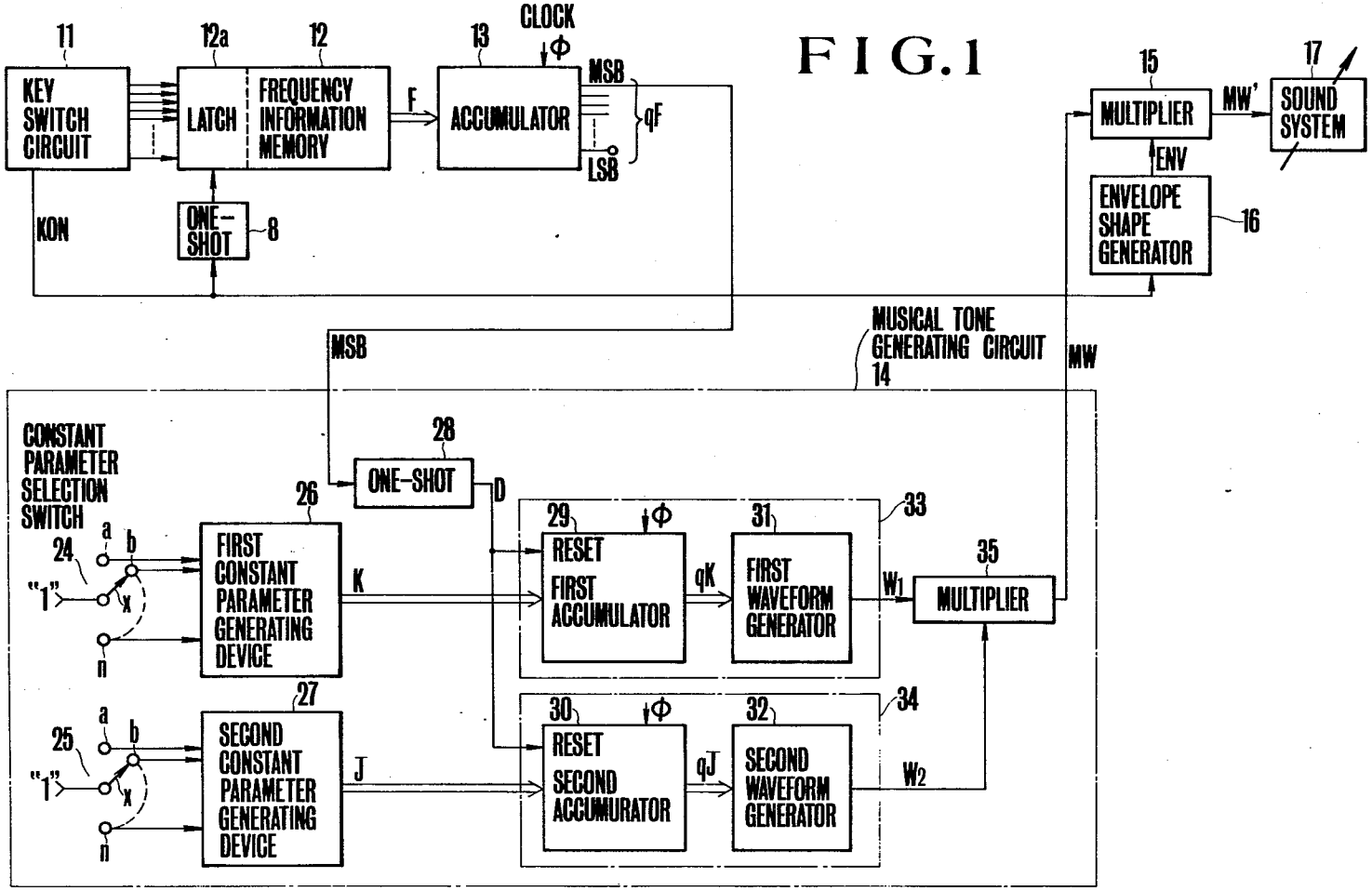
FIG. 1 is a block diagram showing one embodiment of the electronic musical instrument embodying the invention.

FIG. 1 shows one embodiment of the electronic musical instrument, according to this invention. The electronic musical instrument shown therein is of a monophonic construction and provided with a key switch circuit 11 provided for a keyboard unit. The key switch circuit 11 comprises a plurality of key switches respectively corresponding to the keys of keyboard unit. Accordingly, when a key is depressed, a key switch corresponding thereto is operated to produce a binary single "1" on its output line. In this example, the key switch circuit 11 contains a single note preferential selector so that where a plurality of key switches are operated simultaneously the signal "1" would be produced on only an output line corresponding to a key switch having the highest degree of preference. Also the key switch circuit 11 is constructed to produce a key-on signal KON showing that a certain key has been depressed.

The output lines corresponding to respective key switches of the key switch circuit 11 are connected to the inputs of a frequency information memory device 12 for storing frequency information data F corresponding to the tone pitches of respective keys. Consequently, when a key is depressed a frequency information data corresponding to the tone pitch of that key is read out from the frequency information memory device 12. The frequency information data F read out from the frequency information memory device 12 is supplied to an accumulator 13 which sequentially accumulates the frequency information data in synchronism with a clock pulse $\phi$ to produce the accumulated value qF (where q=1, 2, 3 . . . N) in terms of multi-bits, and the most significant bit signal (MSB) of the accumulated value qF is sent to a musical tone generating circuit 14. In this circuit, the most significant bit signal is subjected to a processing (described later) to send a musical tone (tone signal) waveform MW having a frequency corresponding to the tone pitch of the depressed key to a multiplier 15, which is connected to also receive the output of an envelope shape generator 16.

In response to the key-on signal KON generated by the key switch circuit 11, the envelope shape generator 16 generates an envelope shape ENV comprising an attack section, a connection section and a decay section for controlling the volume envelope. Thus, the multiplier 15 functions to multiply the musical tone waveform MW generated by the musical tone generating circuit 14 with the envelope shape ENV generated by the envelope shape generator 16 thus applying the volume envelope to the musical tone waveform MW. The musical tone waveform MW' imparted with the volume envelope is supplied to a sound system 17 comprising a filter, an amplifier and a loudspeaker to produce a performance tone.

A latch circuit **12*a* is provided on the input side of the frequency information memory device 12 so as to generate a decaying musical tone after the release of a depressed key by supplying the output of the key switch circuit 11 to the frequency information memory device 12. For this reason, the latch circuit 12*a* is connected to receive the key-on signal KON through a one-shot circuit 18 which acts as a strobe signal thus causing the latch circuit 12*a* to perform a latching operation during the building-up of the key-on signal KON. Consequently, the latched output of the key switch circuit 11** would be held until another new key is depressed and the key-on signal KON builds-up.

The detail of the construction of the musical tone generating circuit 14 which characterizes the invention will now be described. As shown, the musical tone generating circuit 14 comprises constant parameter selection switches 24 and 25 each including a movable contact x supplied with signal "1" and a plurality of stationary contacts a through n selectively engaged by the movable contact x, first and second constant parameter generators 26 and 27 each including a memory device having addresses in which constant parameters K and J having different values are stored, and produces the constant parameters K and J when addressed by the outputs of the constant parameter selection switches 24 and 25, a one shot circuit 28 which is connected to receive the most significant bit signal MSB of the accumulated value qF produced by the accumulator 3 for producing a pulse D synchronous with the build-up of the most significant bit signal; and first and second accumulators 29 and 30 which sequentially accumulate the constant parameters K and J respectively parameter generators 26 and 27 under the control of the clock pulse $\phi$, the accumulated and increasing parameters qK and qJ of the first and second accumulators being reset each time when the pulse D is produced by the one shot circuit 28. There are also provided first and second waveform generators 31 and 32 constituted by memory devices which are address controlled by the accumulated values qK and qJ respectively produced by first and second accumulators 29 and 30. Amplitude values at successive sampling points of one period of a sine wave are stored in respective addresses of the first waveform generator 31 whereas the amplitude value at successive sampling points of a waveform shown in FIG. 2A which is unidirectional and whose amplitude decreases gradually in the later half of the waveform. The first accumulator 29 and the first waveform generator 31; and the second accumulator 30 and the second waveform generator 32 constitute first and second waveform generating circuits 33 and 34 respectively. Furthermore, a multiplier 35 is provided to multiply each other the waveform signals $W_1$ and $W_2$ respectively produced by the first and second waveform generating circuits 33 and 34 to produce a musical tone waveform MW in which the waveform signal $W_1$ is modulated by the waveform signal $W_2$.

In the electronic musical instrument described above when the movable contacts x of the constant parameter selection switches 24 and 25 are thrown to either ones of the stationary contacts the signals "1" supplied to the movable contacts x are produced by the selected stationary contacts to designate addresses of the first and second constant parameter generators 26 and 27 respectively. Consequently, the constant parameter K which has been stored in a memory area or address which is addressed by the output of the constant parameter selection switch 24 is read out from the first constant parameter generator 26, whereas the constant parameter K which has been stored in an address which is addressed by the output of the constant parameter selection switch 25 is read out from the second constant parameter generator 27.

Figure 2A:
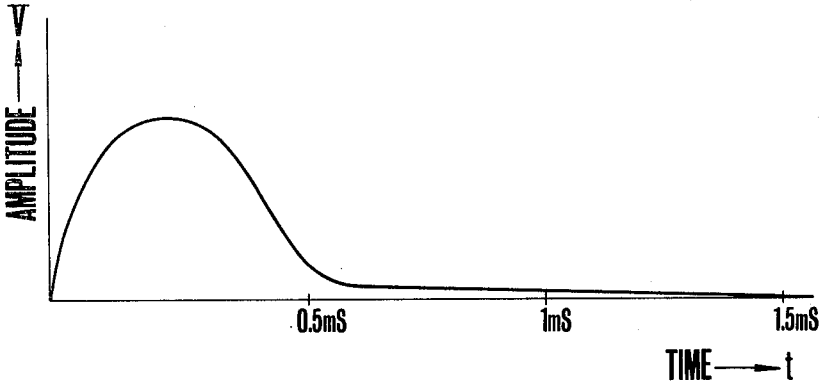
FIGS. 2A, 2B and 2C show waveforms which are useful to explain the operation of the musical tone generating circuit shown in FIG. 1.
Figure 2B:
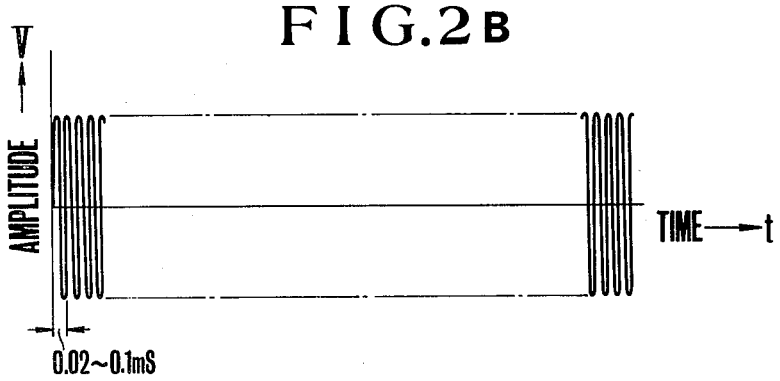
Figure 2C:
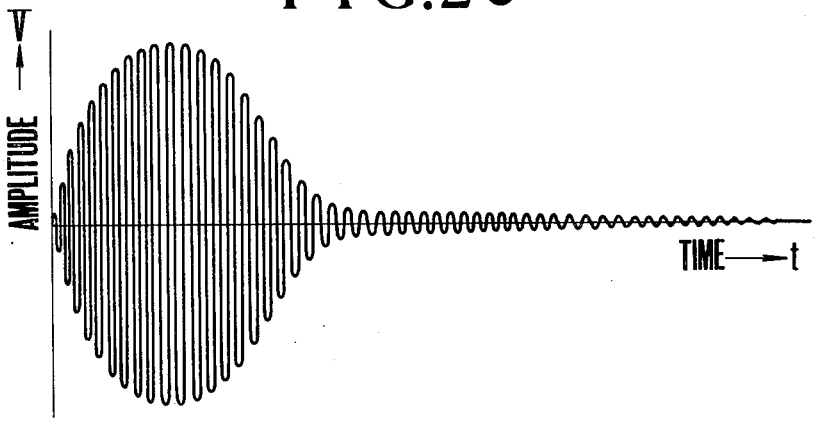

Under these conditions when a key of the keyboard is depressed, the key switch circuit 14 produces a binary signal "1" only on an output line corresponding to the depressed key and the frequency information memory device 12 is addressed by this output signal to read out a frequency information data F corresponding to the tone pitch of the depressed key. When the key switch circuit 11 pro duces a key-on signal KON which shows that a certain key has been depressed. In response to this key-on signal KON, the one-shot circuit 18 produces a pulse synchronous with the build-up of the signal KON, and the latch circuit **12*a* of the frequency information memory device 12 is operated by the output of the one-shot circuit 18 so that the input signal to the frequency information memory device 12 is maintained until another key-on signal KON is produced in response to the depression of a new key. The frequency information data F produced by the frequency information memory device 12 and corresponding to the tone pitch of the depressed key is applied to the accumulator 13 which sequentially accumulates the data F under the control of the clock pulse $\phi$ thereby producing an accumulated value qF. When the accumulated value qF exceeds the maximum accumulatable value (modulo) the accumulator 13 overflows to repeat its accumulating operation. The most significant bit signal (MSB) of the accumulated value qF of the accumulator 13 is applied to the one-shot circuit 28 to produce a pulse D synchronous with the build-up of the most significant bit signal. In other words, the pulse D is generated in synchronism with the period of the accumulated value to reset the first and second accumulators 29 and 30 of the first and second waveform generating circuits 33 and 34, respectively. The first and second accumulators 29 and 30, thus reset sequentially accumulate again the constant parameters K and J respectively produced by the first and second constant parameter generators 26 and 27 under the control of the clock pulse $\phi$ thus producing accumulated values qK and qJ respectively. In this example, since constant parameter K is selected to be larger than constant parameter J the repetition period of the accumulated value qK is extremely shorter than that of the accumulated value qJ. The accumulated value qK of the first accumulator 29 successively addresses the first waveform generator 31 to continuously read out a sine waveform having a short period, for example of about from 0.02 to 0.1ms, as shown in FIG. 2B. Since the constant parameter K is set to a relatively small value, the repetition period of the accumulated value qJ produced by the second accumulator 30 is relatively long, of the order of about 1.5ms, for example, with the result that the period of the waveform read out from the second waveform generator 32 being addressed by the accumulated value qJ becomes very long as shown by FIG. 2A. Signals $W_1$ and $W_2$ produced respectively by the first and second waveform generators 31 and 32 are multiplied with each other by multiplier 35 to form an output MW having a waveform in which the signal $W_1$ (FIG. 2B) produced by the first waveform generator 31 and having a short repetition period is amplitude modulated by the signal $W_2$ (FIG. 2A) produced by the second waveform generator 32 and having a long period, as shown in FIG. 2C**.

This musical tone waveform MW is multiplied in the multiplier 15 by an envelope shape ENV generated by the envelope shape generator 16 started by the generation of the key-on signal KON, thereby producing a musical tone waveform MW' imparted with an amplitude envelope. The musical tone waveform MW' thus imparted with the amplitude envelope is converted by the sound system 17 into a performance musical tone.

In the electronic musical instrument constructed as above described, the period of the musical tone waveform MW (or MW') is synchronous with the period of generation of pulse D, that is the repetition period of the variation of the accumulated value produced by the accumulator 13 that accumulates the frequency information data F corresponding the tone pitch of the depressed key and this period determining the pitch of the generated musical tone. When the constant parameter K is varied by operating the constant parameter selection switch 24, the frequency (period) of the signal $W_1$ (FIG. 2B) produced by the first waveform generator 31 varies, whereas when the constant parameter J is varied by operating the constant parameter selection switch 25, the width along the time axis of the signal $W_2$ (FIG. 2A) produced by the second waveform generator 32 varies. Accordingly, by varying the constant parameters K and J read out from the first and second constant parameter generators 26 and 27 by operating the constant parameter selection switches 24 and 25, the waveform of the generated musical tone, that is the waveform of the signal $W_1$ generated by the first waveform generator 31 and amplitude modulated by the signal $W_2$ generated by the second waveform generator 32 can be varied.

Figures 3A, 3B, 3C, 3D:
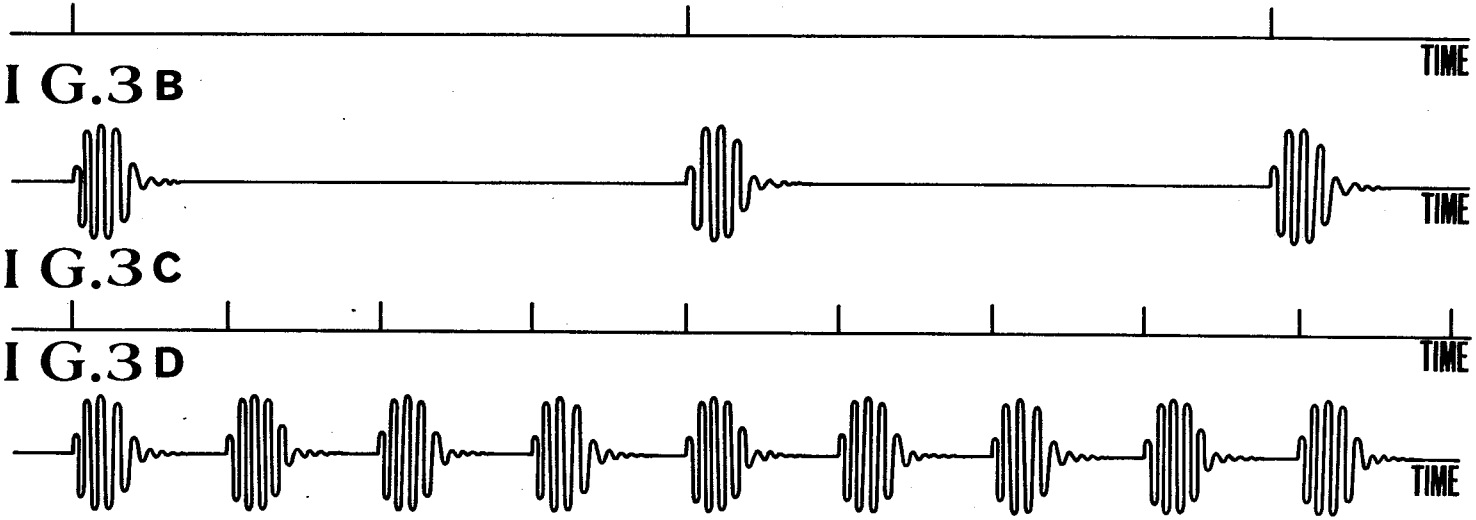
FIGS. 3A through 3D show the relationship between the pulse generated by the accumulator and the output of the musical tone generating circuit shown in FIG. 1.
Figures 4A, 4B, 4C, 4D:
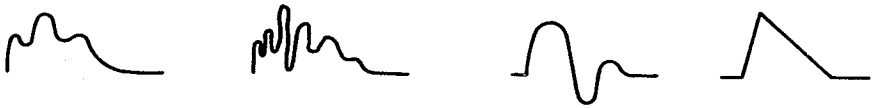
FIGS. 4A through 4D show modified waveforms of the pulse generated by the second waveform generator.

The relationship between the pulse generated by the accumulator 13, that is the output pulse D of the one-shot circuit 28, and the output MW of the musical tone generating circuit 14 is shown in FIGS. 3A through 3D wherein FIGS. 3A and 3C show the waveform of the output pulse D while FIGS. 3B and 3D show the output MW. FIGS. 3A and 3B show a case wherein the tone pitch of the depressed key is low whereas FIGS. 3C and 3D show a case wherein the tone pitch is high.

Consequently, the distribution of respective harmonic components contained in the musical tone waveform varies corresponding to the variation in the musical tone waveform MW, so that it is possible to readily vary the tone of the generated musical tone. As about described, since the pitch of the generated musical tone is determined only by the period of pulse D generated by the one-shot circuit 28 in synchronism with the variation in the period of the accumulated value qF of the accumulator 13 which accumulates the frequency information data of the pitch of the depressed key, the waveform signals $W_1$ and $W_2$ generated by the first and second waveform generating circuits 33 and 34 are not required to have high accuracies and they are required to have accuracies that do not affect the color of the generated musical tone.

Although in this embodiment, the second waveform generator 32 is constructed to generate a waveform shown by FIG. 2A, it is possible to construct it to generate such modified waveforms as shown in FIGS. 4A through 4D.

Figure 5:
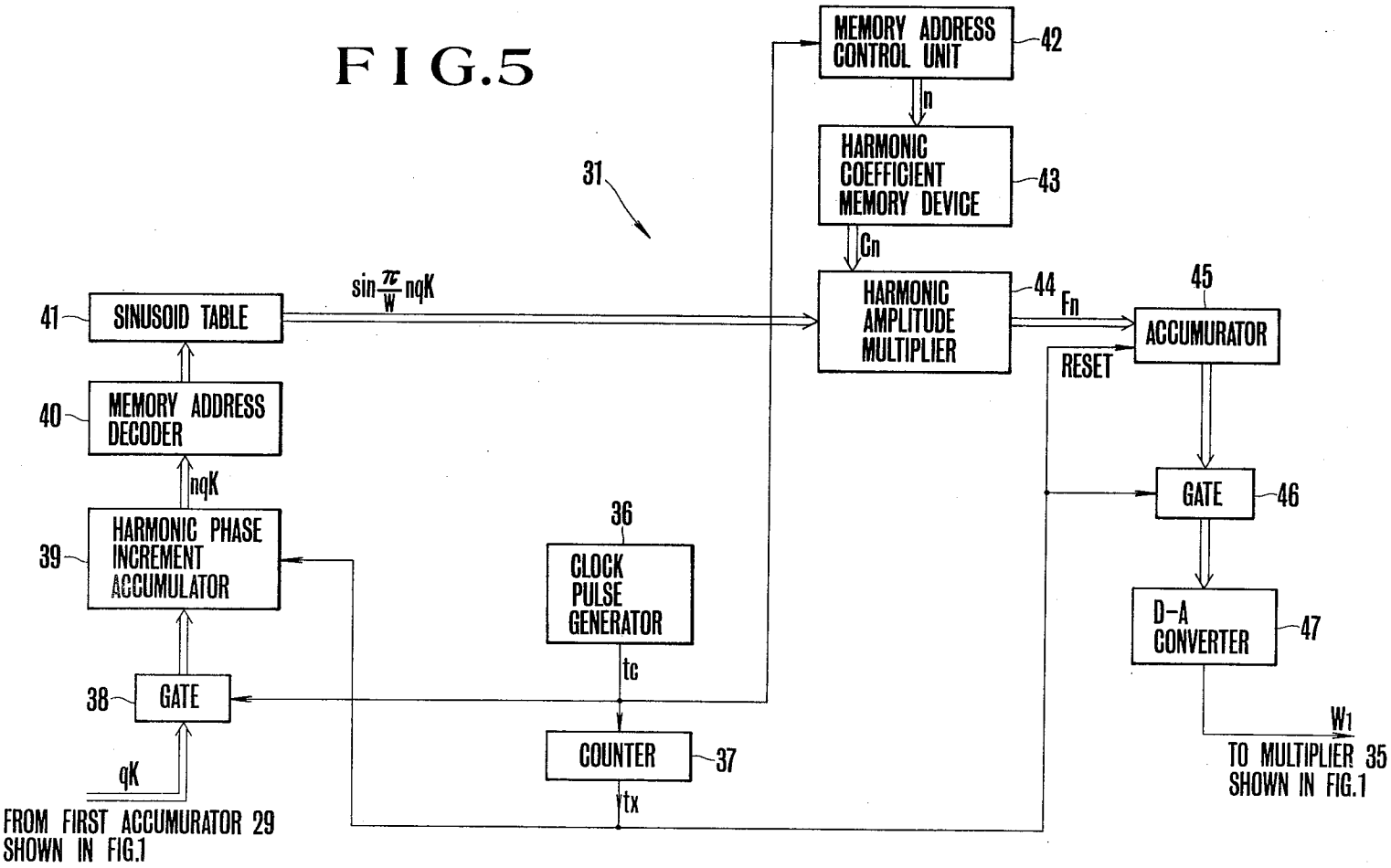
FIG. 5 is a block diagram showing a modified embodiment of this invention utilizing modified first and second waveform generators.

FIG. 5 shows a modified embodiment of this invention utilizing modified first and second waveform generators 31 and 32 of the musical tone generating circuit 14. Although FIG. 5 shows only the first waveform generator 31, it should be understood that the second waveform generator 32 has an identical construction differing only in values.

As shown, the first waveform generator 31 comprises a clock oscillator 36 which generates a clock pulse $t_c$, a counter 37 which decreases the frequency of the clock pulse $t_c$ to 1/W to generate a computation interval timing signal $t_x$ corresponding to the clock pulse $\phi$ shown in FIG. 1, where W represents the total number of the harmonics (including the fundamental wave) to be synthesized, a gate circuit 38 which is opened each time the clock pulse $t_c$ is generated to produce the accumulated value qK of the first accumulator 29 shown in FIG. 1, and a harmonic phase increment accumulator 39 which sequentially accumulates the output qK of the gate circuit 38 to produce an accumulated value nqK (where n=1, 2, 3 . . . W), the content (accumulated value nqk) of the accumulator 39 being reset each time the computation interval timing signal $t_x$ is generated. There are also provided a memory address decoder 40 which decodes the accumulated value nqK produced by a harmonic phase increment accumulator 39 to address a sinusoid table 41 having addresses storing the amplitude values at successive points of a sine waveform for reading out a sine wave amplitude value sin $\pi$/W nqK stored in the address, and a memory address control device 42 which sequentially counts the clock pulse $t_c$ in synchronism with the operation of the counter 37 for producing its count of an address signal n. The memory address control device 42 is constituted by a counter having modulo W.

The first waveform generator 31 further comprises a harmonic coefficient memory device which stores harmonic amplitude coefficients $C_n$ for respective harmonics and constructed such that the harmonic amplitude coefficients $C_n$ are sequentially read out by an address signal n(n represents the order of the harmonics produced by the memory address control device 42), a multiplier which multiplies the sine amplitude value sin $\pi$/W nqK produced by the sinusoid table 41 with the harmonic amplitude coefficient $C_n$ produced by the harmonic coefficient memory device 43 to produce a product Fn, an accumulator 45 which accumulates the product Fn to produce an output and is reset each time the computation interval timing signal $t_x$ is generated, a gate circuit 46 which is opend each time the computation interval timing signal $t_x$ is generated for producing the accumulated value of the accumulator 45 and a digital analogue converter 47 which converts the output of the gate circuit 46 into an analogue quantity which is supplied to the multiplier 35 shown in FIG. 1.

With this modified first waveform generator 31, the accumulated value qK which is sequentially varied by the clock pulse $\phi$ (the computation interval timing signal $t_x$) is supplied to the harmonic phase increment accumulator 39 via the gate circuit 38 controlled by the clock pulse $t_c$. Since, in this example, the clock pulse $t_c$ has a frequency W times of that of the computation interval timing signal $t_x$ (clock pulse $\phi$) the gate circuit 38 would be opened W times during one period of the computation interval timing signal $t_x$. As a consequence, the harmonic phase increment accumulator 39 sequentially adds the accumulated value qK produced by the gate circuit 38 each time a clock pulse $t_c$ is generated for producing the accumulated value nqK (n=1, 2, 3 . . . W). When the adder 39 completes its accumulating operations of W times, it is reset by the computation interval timing signal $t_x$ and then repeats this operation. Consequently the harmonic phase increment accumulator 39 generates the accumulated value nqK which gradually increases according to the clock pulse $t_c$ during one period of the computation interval timing signal $t_c$. The accumulated value nqK is decoded by the memory address decoder 40 and the decoded output thereof is supplied to act as the address signal to the sinusoid table 41 storing the amplitude values successive sampling points of one period of a sine waveform to read out the sine amplitude value sin $\pi$/W nqK from the memory device 41.

As can be noted from the foregoing description, the accumulated value qK of the first accumulator 29 shown in FIG. 1 shows the successive sampling points to be calculated of the waveform signal $W_1$ generated by the first waveform generator 31, whereas the accumulated value nqK of the harmonic phase increment accumulator 39 represents the phase of the n-th harmonic at a sampling point now being calculated. Consequently, the sinusoid table 41 sequentially generates the sine amplitude values sin $\pi$/W nqK (n=1, 2 . . . W) of respective harmonics (including the fundamental wave) at the corresponding sampling point qK in the order of the fundamental wave (first harmonic), the second harmonic . . . W-th harmonic. The sampling point of the waveform signal $W_1$ successively moves each time the computation interval timing signal $t_x$ is generated, but to which sampling point should be moved is determined by the constant parameter K generated by the first constant generator 26 shown in FIG. 1. As a consequence, the sinusoid table 41 sequentially generates, on the time division bases, the sine amplitude values sin $\pi$/W nqK of respective harmonics in a period proportional to the constant parameter K.

The memory address control device 42 produces an address signal n (representing the order of the harmonic wave) which varies sequentially in synchronism with the clock pulse $t_c$ and the address signal is supplied to the harmonic coefficient memory device 43. Upon application of the address signal n, the harmonic coefficient memory device 43 sequentially generates the harmonic amplitude coefficient $C_n$ that sets the amplitude values of respective harmonics stored in respective addresses. In the harmonic amplitude multiplier 44, the harmonic amplitude coefficient $C_n$ is multiplied with the sine amplitude values sin $\pi$/W nqK of respective harmonics read out from the sinusoid table 41, on the time division basis, at successive sampling points. The product Fn of the multiplier 44 is supplied to the accumulator 45. Since the memory address control device 42 is synchronized with the harmonic phase increment accumulator 39 the harmonic amplitude coefficient $C_n$ sequentially read out for each harmonic is multiplied with a corresponding sine amplitude value sin $\pi$/W nqK thereby setting the amplitude value Fn of each harmonic. The accumulator 45 functions to sequentially accumulates the amplitude values Fn of respective harmonics sequentially produced by the harmonic amplitude multiplier 44, and the accumulated value $$\sum_{n=1}^{W}$$

Fn is supplied to the D-A converter 47 through the gate circuit 46 each time a computation interval timing signal $t_x$ is generated. The accumulator 45 is reset by the computation interval timing signal $t_x$ to repeat the same accumulating operation for calculating the amplitude values at successive sampling points. Consequently, the D-A converter 47 is supplied with the waveform amplitude values at successive sampling points corresponding to the accumulated value qK of the accumulator 29 (FIG. 1) each time a computation interval timing signal $t_x$ is generated whereby the D-A converter 47 generates an analogue signal $W_1$ having a waveform set by each harmonic amplitude coefficient $C_n$ in a period corresponding to the constant parameter K. In this regard, it is possible to vary the frequency (period) of the output waveform signal $W_1$ by changing the constant parameter K by operating the constant parameter selection switch 24 shown in FIG. 1. It is also possible to generate a waveform signal $W_1$ having any complicated waveform by selecting various values of the harmonic amplitude coefficient $C_n$ to be stored in the harmonic coefficient memory device 41 whereby it is easy to make complicate the tone color of the generated musical tone.

Figure 6:
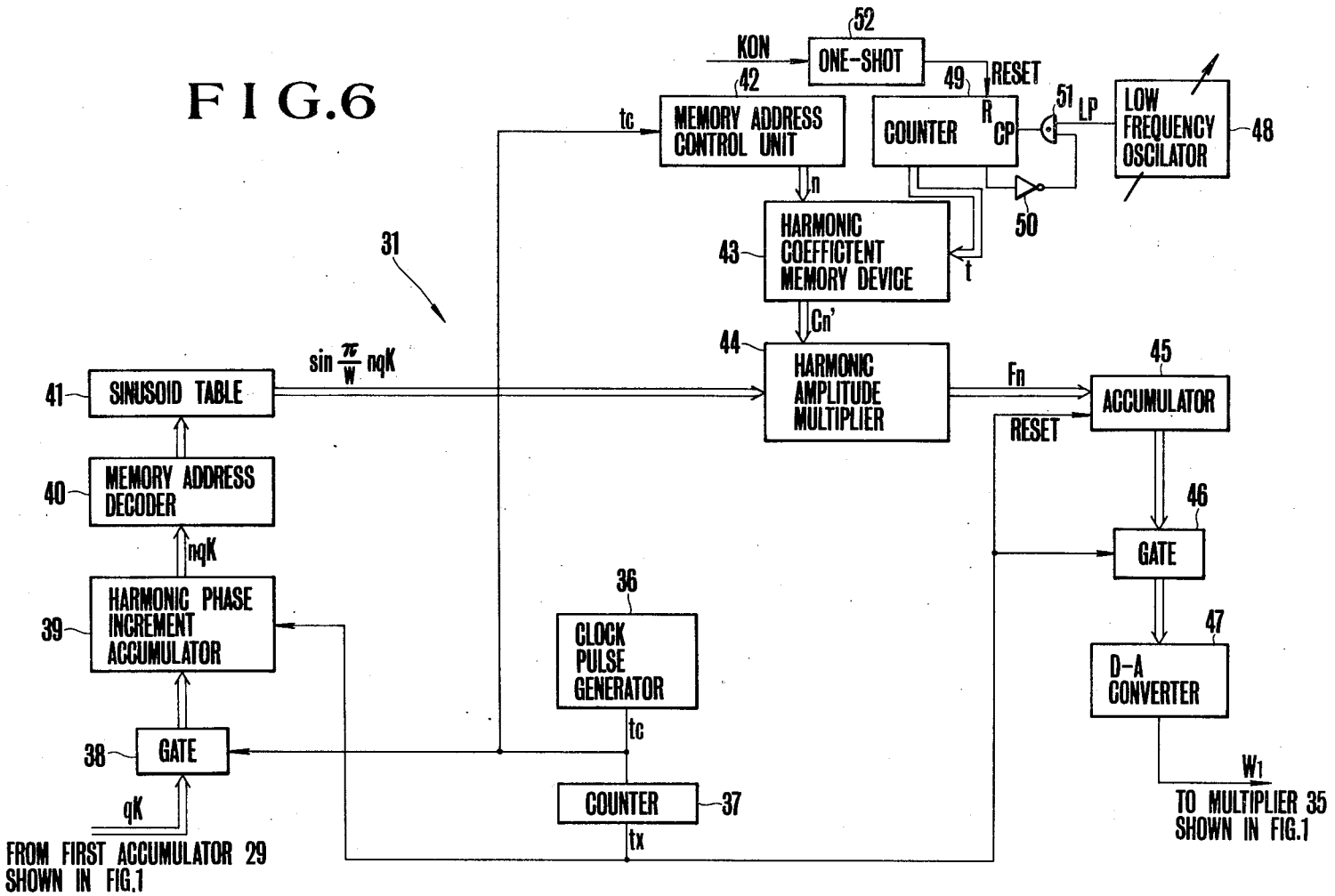
FIG. 6 is a block diagram showing a modified waveform generator.

FIG. 6 shown another modification of the waveform generator 31 or 32 in which elements corresponding to those shown in FIG. 5 are designated by the same reference characters. In this modification, there are provided a low frequency oscillator 48 which generates a low frequency pulse, a counter 49 which applies its output to the harmonic coefficient memory device 43 to act as the address designating signal, an inverter 50 which inverts a signal "1" produced at the maximum count of the counter 49, an AND gate circuit 51 which supplies the output LP of the low frequency oscillator 48 to the count input CP of the counter 49 in response to the output of the inverter 50 and a one-shot circuit 52 which supplies a pulse synchronous with the build-up of the key-on signal KON to the reset terminal of the counter 49 for resetting the same.

This modification operates as follows: Thus the counter 49 is reset by the pulse generated by the one-shot circuit 52 which is produced at the time of building up of the key-on signal KON produced by a depressed key. Consequently, the output of inverter 50 which is produced when the count of the counter 49 reaches a maximum becomes "1" whereby the output LP of the low frequency oscillator 48 would be supplied to the count input CP of the counter 49. Each time the low frequency oscillator 48 generates a pulse LP, the counter 49 counts it and when the count of the counter reaches the maximum count (all "1") the output of the inverter 50 becomes "0". Thus, the AND gate circuit 51 is disabled to step the counting operation of the counter. The count of the counter 49 which increases gradually in accordance with the output pulse LP of the low frequency oscillator 48 is applied to the harmonic coefficient memory device 43 to act as the address signal t. The harmonic coefficient memory device 43 is addressed by the output n of the memory address control device 42 and by the output t of the counter 49 to produce a predetermined harmonic amplitude coefficient $C_n'$ which is a function of the order (n) of the harmonic and time (t). Since the output (t) of the counter 49 varies with the oscillation frequency of the low frequency oscillator 48 the value of the harmonic amplitude coefficient $C_n'$ produced by the harmonic coefficient memory device 43 varies with time for each order of the harmonic but becomes a constant value when and after the count of the counter 49 reaches the maximum value. Consequently, when this harmonic amplitude coefficient $C_n'$ is multiplied by the harmonic amplitude multiplier 44 with the sine amplitude value $\sin \pi/W\ nqK$ produced by the sine function memory device 41 the product Fn varies with time for each order of the harmonic, and maintains a constant value after the full count.

Consequently, when the waveform generator 31 (32) shown in FIG. 6 is used in the electronic musical instrument shown in FIG. 1 it is possible to generate musical tones, rich in naturality, by delicately varying the color of the generated musical tone as the time elapses from the commencement of the tones just in the same manner as the tones generated by natural musical instruments.

Figure 7:
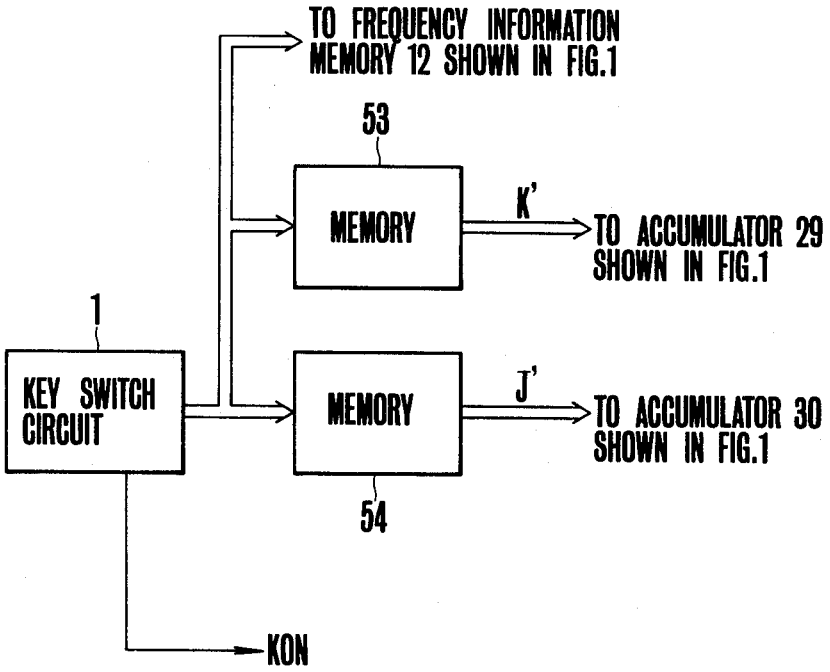
FIG. 7 is a block diagram showing an improved constant parameter generating circuit.

FIG. 7 shows a portion of the another embodiment of the electronic musical instrument according to this invention which relates to the improvement of constant parameter generating means comprising first and second constant parameter generators 26, 27 and constant parameter selection switches 24 and 25 shown in FIG. 1. A memory device 53 is provided for storing constant parameters K' which are different in accordance with the octave ranges (for example one octave unit or one half octave unit) of respective keys of the keyboard. The memory device 53 is addressed by the output of the key switch circuit 1 to produce a constant parameters K' corresponding to the octave range belonging to a depressed key. There is also provided a memory device 54 which stores the constant parameters J' having different values corresponding to the tone pitches of the respective keys. The memory device 54 is addressed by the output of the key switch circuit 1 to produce a constant parameter J' corresponding to the tone pitch of a depressed key.

The constant parameters K' and J' respectively read out from the memory devices 53 and 54 are supplied to the first and second accumulators 29 and 30 respectively shown in FIG. 1 and accumulated sequentially therein under the control of the clock pulse $\phi$.

When the constant parameter generating means is constructed as above described, the first accumulator 29 produces an accumulated value qK' which varies in accordance with the octave range to which a depressed key belongs, whereas the second accumulator 30 produces an accumulated value qJ' which varies in accordance with the tone pitch of the depressed key. Consequently, the first waveform generator 31 addressed by the accumulated value qK' of the first accumulator 29 produces a waveform signal $W_1$ (FIG. 2A) having a period corresponding to the octave range to which the depressed key belongs, the period of the waveform signal $W_1$ varying depending upon the octave range to which the depressed key belongs. The second waveform generator 32 addressed by the accumulated value qJ' of the second accumulator 30 generates a waveform signal $W_2$ (FIG. 2A) having a period corresponding to the tone pitch of the depressed key, the period of the waveform signal $W_2$ varying with the tone pitch of the depressed key.

Consequently, the waveform MW ($=W_1 \times W_2$) of the musical tone produced by the multiplier 35 varies in accordance with the octave region to which the depressed key belongs since the waveform signal $W_1$ varies in accordance with the octave range to which the depressed key belongs. The pulse D generated by the one-shot circuit 23 shown in FIG. 1 determines the period (frequency) of the musical tone waveform MW, and as has already been described the period of the generated pulse varies in accordance with the tone pitch of the depressed key. As above described, the period of the waveform signal $W_2$ also varies in accordance with the tone pitch of the depressed key. Thus, the period of generation of the pulse D and the period of the waveform signal $W_2$ coincide with each other (as the period of the pulse decreases, the period of the waveform signal $W_2$ also decreases). Consequently, the resetting of the waveform, signal $W_2$ by the pulse D is effected always at substantially the same position of the waveform signal $W_2$ regardless of the tone pitch of the depressed key. More particularly, when the pulse D is generated the waveform signal $W_2$ always assumes its later half portion (the portion in which the amplitude of the waveform shown in FIG. 2A is substantially zero) so that no noise would be caused by the resetting even when the waveform signal $W_2$ were reset at this poriton. In contrast, if the waveform signal $W_2$ were reset at the fore half portion thereof (FIG. 2A), as the signal $W_2$ would rapidly decrease to zero from a certain amplitude value, noise would have resulted. Where the waveform signal $W_2$ is generated in response to a constant parameter J as shown in FIG. 1 the period of the waveform signal $W_2$ is always constant regardless of the tone pitch of the depressed key so that the period of generation of the pulse D becomes shorter as the tone pitch of the depressed key increases with the result that the waveform signal $W_2$ will be reset in the fore half thereof thus causing noise accompanying the resetting. However, this difficulty can be obviated by the modified embodiment shown in FIG. 7.

Thus, according to this modification it is possible to produce high quality musical tones wherein the tone color varies in accordance with the octave range to which the depressed key belongs and wherein any unwanted noise is formed.

Since the constant parameters K' and J' of this modification are not used to determine the frequency of the generated musical tones, they are not required to have such accuracies as the frequency information data F described above. Furthermore it is not necessary to set the constant parameter J' for each key but it may correspond to the octave region as the constant parameter K'. In addition, the constant parameters K' and J' may be formed by utilizing the frequency information data F without providing exclusive memory devices 53 and 54.

Although in the embodiments described above a sine wave was repeatedly generated by the first waveform generator 31 and a waveform having a single polarity and decreases substantially to zero during the later half of one period was generated by the second waveform generator, it should be understood that the invention is not limited to such specific construction and that any waveform generators which respectively generate a repetition wave having a relatively short period and a waveform having a relatively long period and gradually decreases to substantially zero in the later half of one period.

As the waveform generators 31 and 32 may be used a frequency modulation system disclosed in, for example, U.S. Pat. No. 4,018,121, a WALSCH function system disclosed in U.S. Pat. No. 3,878,749 or any other system that generates waveform signals that can fulfill the conditions described above.

Furthermore, instead of using the accumulated and increasing value qF which is produced by accumulating at a predetermined speed the frequency information F corresponding to the tone pitch of a depressed key as the means for periodically resetting the waveform generators 31 and 32 in accordance with the tone pitch of a depressed key it is also possible to form a pulse signals having frequencies corresponding to the tone pitches of respective keys, and to select one of the pulse signals corresponding to a depressed key for resetting the waveform generators. Of course any other method can be used so long as it can form a pulse signal having a frequency (period) corresponding to the tone pitch of the depressed key.

As above described, according to the electronic musical instrument of this invention, a repetition waveform which is generated periodically with a period corresponding to a first constant parameter, and another waveform which is also generated periodically in accordance with a second constant parameter and having a larger period than the first mentioned waveform and decreases substantially to zero in the later half of one period are repeatedly generated and reset in a period corresponding to the tone pitch of a depressed key, and then the two waveforms are multiplied with each other to form a musical tone waveform. Consequently, it is possible to readily change the tone color of the generated musical tone with simple construction by merely changing the constant parameters described above. Furthermore, by changing with time the constant parameters it is possible to generate musical tones, rich in naturality, and having colors delicately vary as the time elapses after commencement of the tones.

What is claimed is:

1. An electronic musical instrument comprising a plurality of key switches which determine a tone pitch of a musical tone generated by said musical instrument;

a periodic trigger pulse generating circuit which generates a trigger pulse having a period corresponding to a designated one of said key switches;

a constant parameter generator which generates a predetermined constant parameter;

first and second waveform generators responsive to said periodic trigger pulse and to the output of said constant parameter generator for producing outputs having different waveforms;

a multiplying circuit to multiply with each other the outputs of said first and second waveform generators for producing a musical tone waveform element;

said first waveform generator generating an oscillatory waveform;

said second waveform generator generating another waveform which builds up from a predetermined reference level to a higher level and then decreases toward said reference level;

said musical tone waveform element having an envelope which increases from zero to a predetermined value and then decreases to zero; and means for repeatedly generating said musical tone waveform element at a period corresponding to the period of said trigger pulse so as to form a musical tone wave thereby repeatedly generating said musical tone waveform element to form said musical tone.

2. An electronic musical instrument according to claim 1 wherein each of said first and second waveform generators comprises an accumulator which is reset by said trigger pulse and accumulates said constant parameter in response to a clock pulse, memory means which stores amplitude values at a plurality of sampling points along a waveform, means for designating one after another of said sampling points in response to the output of said accumulator to read one after another of the amplitude values stored at the respective sampling points in said memory means, and means for forming said waveforms in response to said read out amplitude values.

3. An electronic musical instrument according to claim 2 wherein said means for forming said waveform comprises a memory device which stores the amplitude values at sampling points of a sine wave, a first circuit wherein said memory device is accessed by the output of said accumulator to form a plurality of harmonic signals, a second circuit for producing a plurality of coefficients which modify said harmonic signals, a multiplier circuit for multiplying with each other the outputs of said first and second circuits and a circuit for synthesizing the result of multiplying operations of said multiplier circuit.

4. An electronic musical instrument according to claim 3 wherein said plurality of coefficients generated by said second circuit and modifying said harmonic signals vary as time goes by.

5. An electronic musical instrument according to claim 4 wherein said second circuit comprises a memory device for storing a plurality of sets of coefficients, and a circuit for selecting said plurality of sets of coefficients as time goes by.

6. An electronic musical instrument according to claim 1 wherein said constant parameter generator includes two constant parameter generating circuits which send constant parameters having different values to said waveform generators.

7. An electronic musical instrument according to claim 6 wherein each constant parameter generating circuit comprises memory means for storing a plurality of said constant parameters, and means for selecting said stored constant parameters.

8. An electronic musical instrument according to claim 7 wherein said selecting means is connected to respond to the outputs of said key switches for performing said selection.

* * * * *

UNITED STATES PATENT AND TRADEMARK OFFICE

CERTIFICATE OF CORRECTION

PATENT NO. : 4,200,021

DATED : April 29, 1980

INVENTOR(S) : Masanobu Chibana

It is certified that error appears in the above-identified patent and that said Letters Patent are hereby corrected as shown below:

Col. 4, line 2, change "a" to -- a -- ;

Col. 4, line 2, change "n" to -- n -- ;

Signed and Sealed this

*Twenty-first* Day of *October 1980*

[SEAL]

*Attest:*

SIDNEY A. DIAMOND

*Attesting Officer*

*Commissioner of Patents and Trademarks*